US006480170B1

(12) United States Patent
Langley et al.

(10) Patent No.: US 6,480,170 B1
(45) Date of Patent: Nov. 12, 2002

(54) PATCH ANTENNA

(75) Inventors: Richard Jonathan Langley, Kent (GB); Gisela Clasen, Kent (GB)

(73) Assignee: Harada Industries (Europe) Limited, Birmingham (GB)

( * ) Notice: Subject to any disclaimer, the term of this patent is extended or adjusted under 35 U.S.C. 154(b) by 0 days.

(21) Appl. No.: 09/673,528

(22) PCT Filed: Apr. 15, 1999

(86) PCT No.: PCT/GB99/01158

§ 371 (c)(1),
(2), (4) Date: Mar. 19, 2001

(87) PCT Pub. No.: WO99/53568

PCT Pub. Date: Oct. 21, 1999

(30) Foreign Application Priority Data

Apr. 15, 1998 (GB) ..... 9808042

(51) Int. Cl.[7] ..... H01Q 21/00; H01Q 1/38
(52) U.S. Cl. ..... 343/826; 343/700 MS
(58) Field of Search ..... 343/700 MS, 850, 343/825, 826

(56) References Cited

U.S. PATENT DOCUMENTS

| | | | | |
|---|---|---|---|---|
| 4,053,895 A | | 10/1977 | Malagisi | 343/700 |
| 4,379,296 A | | 4/1983 | Farrar et al. | 343/700 |
| 4,775,866 A | | 10/1988 | Shibata et al. | 343/700 |
| 5,621,422 A | | 4/1997 | Wang | 343/895 |
| 5,966,096 A | * | 10/1999 | Brachat | 343/700 MS |
| 6,252,549 B1 | * | 6/2001 | Derneryd | 343/700 MS |

FOREIGN PATENT DOCUMENTS

| | | | |
|---|---|---|---|
| DE | 4329123 A1 | 3/1995 | H01Q/13/10 |
| EP | 0805512 A1 | 11/1997 | H01Q/9/04 |

OTHER PUBLICATIONS

Arai et al., A Flat Energy Density Antenna System for Mobile Telephone, Published on May 1, 1991.

* cited by examiner

*Primary Examiner*—Don Wong
*Assistant Examiner*—Hoang Nguyen
(74) *Attorney, Agent, or Firm*—Pennie & Edmonds LLP

(57) ABSTRACT

A patch antenna comprises a radiating element and a ground plane with a dielectric therebetween, one or both of the radiating element and the ground plane comprising means defining current paths in a pattern which approximates to a preferred excitation mode of a patch radiating element of uniform and continuous section.

20 Claims, 3 Drawing Sheets

First Set of Lines

TM11 *Fig. 2A*

Second Set of Lines

TM21 *Fig. 3A*

TM01 *Fig. 4A*

$TM_{01}$ $TM_{11}$ $TM_{21}$

PATCH ANTENNA

This invention relates to patch antennas, particularly (but not exclusively) for microwave or near-microwave applications. The invention has particular utility in the provision of antennas for attachment to, or formed on or built into, the windows of buildings, or the windows or nonmetallic body panels of vehicles.

Figure 1:
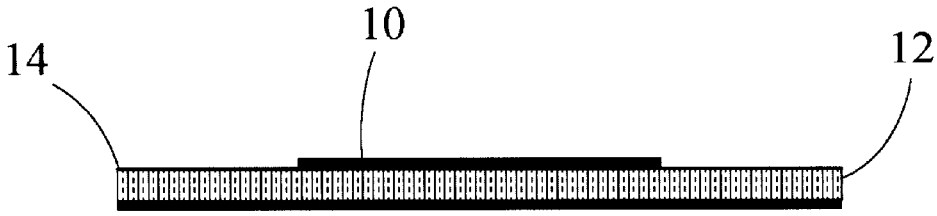

For convenience, the invention is described and claimed in terms of a transmitting antenna. However, since an antenna is intrinsically a functionally reversible device, the invention relates equally to antennas for use in a transmitting mode, a receiving mode, or both, and the claims are to be interpreted as extending to all such antennas;

FIG. 1 of the accompanying drawings shows a conventional patch antenna, consisting of a conducting radiating element or "patch" 10 separated from a conducting ground plane 12 by a dielectric layer 14. The patch is a piece of foil or other sheet-like conductive material adhered or printed on to the surface of the dielectric, and is of continuous and uniform section (thickness) in its plane. It will be appreciated that the term "plane" is here used figuratively; the antenna, if conforming to a curved surface, such as a body panel or rear window of a vehicle, will not be strictly planar in the geometrical sense.

The radiating element is fed either by a physical connection to a suitable conductor or is electromagnetically coupled to a microstrip line.

In such antennas transmission is effected via fringing fields between the radiating element 10 and the ground plane 12. These fields depend on the distribution of the currents flowing in the radiating element and the ground plane.

The current distribution is in accordance with one of several modes which are determined by the shape and size of the patch. It is not possible to configure the antenna always to operate in the desired mode across its full operating range, with the result that the radiation pattern of the antenna is adversely affected. The performance of the antenna, in particular bandwidth and gain for example, then may be reduced compared to its performance in the preferred mode.

European Patent Application No. 0 805 512 A1 (Brachat) discloses an antenna having a circular radiating element with four radial slots, and also comprising a series of diodes each bridging a respective one of the slots. A generally circular current pattern is present in each of the quadrants of the radiating element when a signal is transmitted or received on the radiating element.

The present invention, at least in its preferred embodiments, is directed to alleviating this problem. Some preferred embodiments also provide an antenna with a useful degree of transparency which can be attached to or incorporated in a vehicle windscreen or other window.

The invention provides in one aspect a patch antenna comprising a radiating element and a ground plane with a dielectic therebetween, one or both of the radiating element and the ground plane comprising a plurality of spaced discrete first conductors each defining a respective one of a series of spaced discrete elongated conductors whose longitudinal extents form a pattern approximating to the pattern of a preferred excitation mode in an equivalent patch radiating element of uniform and continuous cross-section.

A second aspect of the invention relates to a window glass or other optically-transparent substrate or a vehicle body part that comprises the patch antenna of the invention.

A third aspect of the invention provides a method of transmitting or receiving radio-frequency energy utilizing the patch antenna of the invention.

Preferably, one or both of the radiating element and ground plane also comprise means for permitting minor currents to flow between respective adjacent pairs of the elongated conductors and, more preferably, that means comprises a plurality of spaced discrete second conductors that intersect the elongated conductors to form a grid pattern. Still more preferably, the plurality of first conductors intersect the plurality of second conductors substantially orthogonally.

The antenna may means for stimulating circularly-polarised emission from the radiating element, and the pattern of the preferred excitation mode may approximate to au excitation mode of a circular or annular patch. Thus, it may be the $TM_{01}$, $TM_{11}$, $TM_{21}$, $TM_{10}$, or $TM_{12}$ mode of such a patch. Other possible modes (without limitation) are $TM_{31}$ and $TM_{41}$.

Alternatively, the pattern may occupy a substantially rectangular or square shape.

Thus (without limitation) the pattern may approximate to the $TM_{10}$, $TM_{11}$, $TM_{21}$, $TM_{01}$ or $TM_{12}$ mode for a uniform square or rectangular patch. Alternatively, the conductors of the square or rectangular pattern may be substantially parallel to a diagonal thereof.

Means may be provided for stimulating circularly-polarised emission from the radiating element.

Thus the radiating element may comprise at least one notch or projection whereby it is adapted to emit circularly-polarised signals.

Opposite corners of a square shape pattern may be absent whereby the radiating element is adapted to emit circularly-polarised signals.

Preferably, there is a solid dielectric disposed between the radiating element and the ground plane.

In one preferred form of the invention, the radiating element and the ground plane both comprise a said conductor pattern, and the dielectric is transparent. Preferably the patterns of the radiating element and the ground plane are identical.

One or both of radiating element and the ground plane may be printed on or otherwise carried by a glass or other transparent substrate.

The invention also comprises a window glass or other optically transparent substrate or a vehicle body part comprising an antenna as set forth above.

Figure 5:
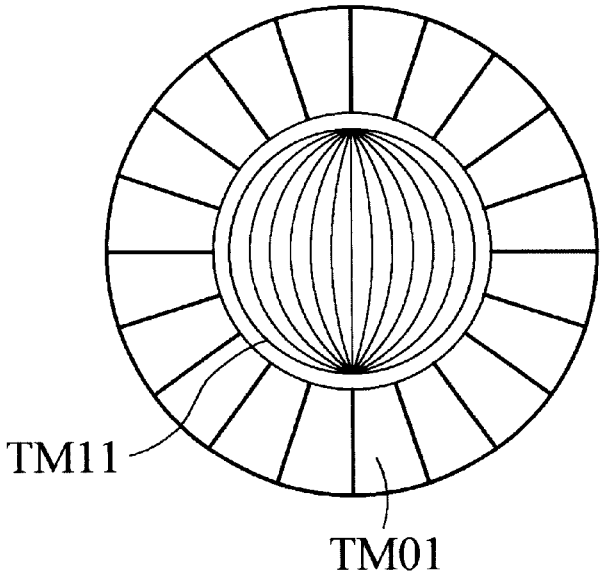

The invention will now be described merely by way of example with reference to the accompanying drawings, wherein:

FIG. 1 (as already discussed) shows a conventional patch antenna;

FIGS. 2*a,* 2*b,* 3*a,* 3*b,* 4*a* and 4*b* show conductor patterns for circular patch antennas according to the invention;

FIG. 5 shows a composite patch antenna according to the invention; and

Figure 7:
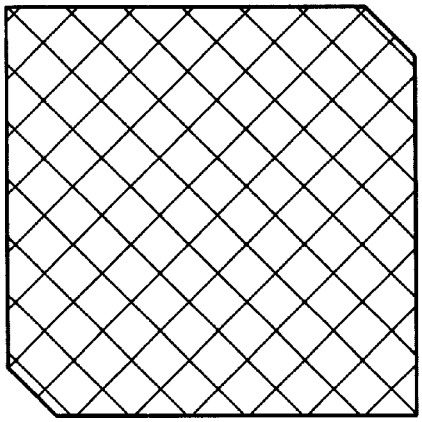
Figure 6A:
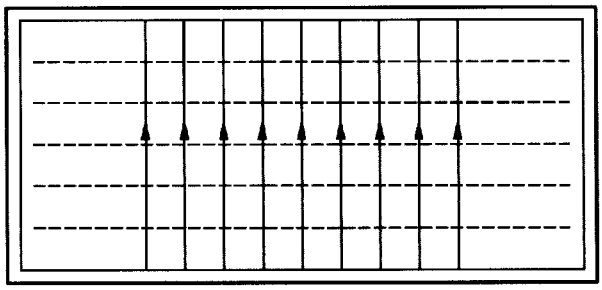

FIGS. 6*a,* 6*b* and 6*c* show conductor patterns for rectangular patch antennas according to the invention;

FIG. 7 shows another form of antenna according to the invention.

Figure 2B:
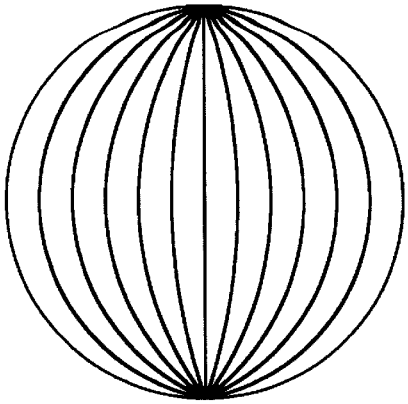

Referring to FIG. 2*a,* when a solid continuous circular patch antenna is operating in its $TM_{11}$ mode, the currents in the patch follow a pattern of paths as shown in the figure. According to this embodiment of the invention, to force this mode of oscillations a patch antenna is manufactured by providing conductors in this pattern on a substrate by any suitable known technique such as etching or photolithography. Preferably at the same time an intersecting conductor pattern as shown in FIG. 2*b* is also provided, concentric with that of FIG. 2*a.* The individual elements of this pattern each intersect the conductors of FIG. 2*a* orthogonally, and permit cross-flows of current between the elements of the FIG. 2*a* pattern so that the current distribution matches that of the $TM_{11}$ mode. It will be appreciated that the intersecting pattern need not be as shown in FIG. 2*b*. The precise pattern is unimportant, provided that it offers adequate opportunities for cross-flow between the elements of the FIG. 2*a* pattern, but does not give rise to an arrangement of alternative current paths such that the patch will support an additional and undesired excitation mode.

Figure 3B:
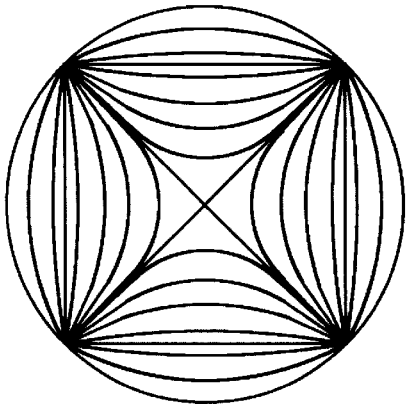
Figure 4B:
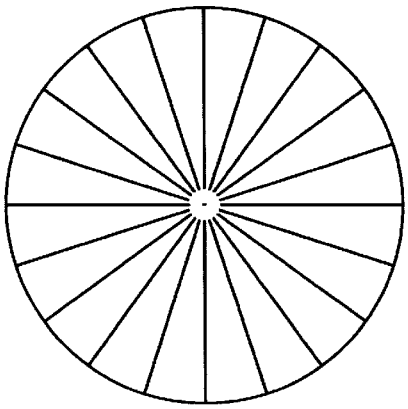
Figure 4B:
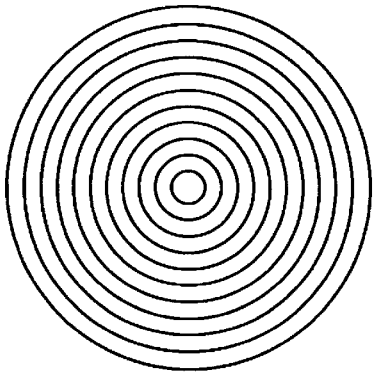

FIGS. 3*a* and 4*a* illustrate conductor element patterns designed to operate respectively in the $TM_{21}$ and $TM_{01}$ excitation modes for a circular patch antenna, and FIGS. 3*b* and 4*b* are suitable current-balancing interconnecting patterns, which again intersect the elements of the FIGS. 3*a* and 4*a* patterns orthogonally.

Such a gridded patch works in a different way to a conventional solid conductor patch. At the resonant frequency of a solid patch, the surface currents produce radiation via electric fields at the edge. The currents are relatively high at the edge of the solid patch and therefore the main radiation comes from the edge. Simulations of the gridded patches show that the currents are not as high at the edges, but being concentrated in the conductors are locally higher than the diffuse currents in a solid patch. The overall current is substantially the same as the solid patch, but the radiation comes from the relatively high local currents on the grid. Consequently the beamwidth is wider than the solid patch as the effective aperture appears smaller, due to tapering of the field distribution. As the number of lines increases the fringing fields are forced to the edges as they become shorted by the proximity of adjacent lines.

The mode-constraining conductor pattern for a particular application is chosen according to the established principles for a solid continuous patch antenna. Thus the $TM_{11}$ mode produces a directional pattern in which the gain is greatest normal to the plane of the patch. This mode is therefore suitable for a horizontally-oriented patch intended for receiving and transmitting signals from and to satellites, for example in satellite-based communication systems, or GPS systems.

The $TM_{01}$ mode produces a directional pattern in which the gain is greatest in directions near-parallel to the plane of the patch. A horizontally-disposed patch thus can be used to replace a conventional upright rod antenna for mobile telephone communications, or for receiving broadcast signals.

The $TM_{21}$ mode produces a pattern in which the sensitivity of the antenna is greatest at an angle of about 35° to the plane of the patch. The $TM_{31}$ and $TM_{41}$ modes (which are not illustrated, but are known per se) produce patterns where the gain of the antenna is greatest at about 45° and 55° respectively to the plane of the patch. A horizontal patch antenna operated in one of these modes may offer a cost effective solution with adequate performance for both vertically-directed and horizontally-directed signals.

However, in general, if both vertical and horizontal sensitivity is required it is likely that a better result will be obtained by using separate $TM_{11}$ and $TM_{01}$ antennas. A compact solution is to arrange one of the patches (eg. the $TM_{01}$ patch) as an annulus around but electrically separate from the other (eg. the $TM_{11}$ patch), as shown in FIG. 5. The intersecting connectors equivalent to FIGS. 2*b* and 4*b* are omitted from the drawing for clarity, but are present. Alternatively the patches may be disposed side by side over a common ground plane.

Another compact solution is to stack the radiating elements concentrically on top of but insulated from each other above a common ground plane. This technique is known for solid patch antennas, and so is not illustrated.

In some circumstances eg. when one patch is very small, it may be advantageous to make only one of the antennas of FIG. 5 gridded, the other (for example the inner one), being solid. Similarly only one of a pair of stacked or side-by-side antennas could be gridded.

Figure 6B:
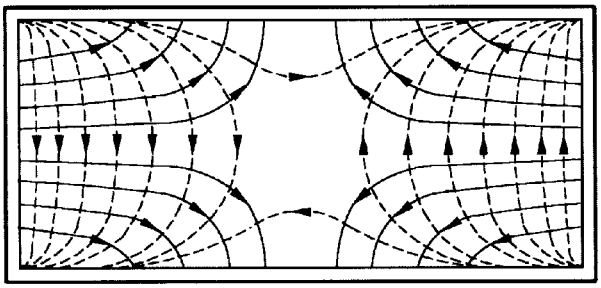
Figure 6C:
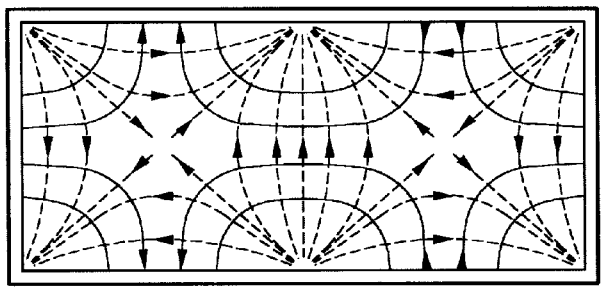

FIGS. 6*a*, 6*b* and 6*c* show some conductor patterns suitable for square or rectangular patches. The dotted lines are the mode-defining conductors and the solid lines represent conductors for minor balancing currents to flow between the mode-defining conductors.

Each mode radiates a different beam shape, eg. the $TM_{01}$ mode radiates a single beam perpendicular to the plane of the patch while the $TM_{11}$, mode radiates a null in that plane. Hence one mode might be suitable for satellite communication while the other is suitable for ground based communications.

The size and spacing of the mode-defining conductors of the grid has an effect on the antenna gain, and on cross-polarisation performance. Measurements were made on a $TM_{11}$ pattern circular patch antenna according to the invention and a $TM_{10}$ square patch antenna also according to the invention. It was found that a spacing of the conductor elements to provide 20 lines/wavelength at the resonant frequency of the antenna gave a reduction in gain compared to an otherwise identical solid patch antenna of 2 dB. Increasing the element density to 40 lines/wavelength reduced the loss to less than 0.5 dB. We believe that as the grid line pitch gets finer the patch will behave increasingly like a solid patch with transmission from the fringing fields. Thus subject to considerations of cost, ease of manufacture and (where relevant) transparency, the lines of the pattern should be of a fine pitch as practicable, consistent with permitting only the preferred mode of excitation.

Other tests have indicated that narrow conductors produce lower cross-polarisation than wide ones, but that for the same thickness for each conductor, wider conductors produce higher gain. It is believed that this is because more metal is present.

A further advantage which has been identified is that a gridded patch can be made smaller than a solid one for a given resonant frequency. For example, a circular solid patch operating in the $TM_{11}$ mode and resonant at 1.49 GHz had a diameter of 38 mm. A circular gridded patch operating in the same mode and resonating at the same frequency had a diameter of only 30 mm. In both cases the patches were mounted on Duroid (a PTFE-based dielectric material) of thickness 0.787 mm and dielectric constant 2.33 above an identical ground plane. This reduction in size can be of assistance where the visual impact of the antenna has to be minimised, and/or in portable equipment where space is limited.

The reduction in size is believed to be attained because in the gridded construction the current pattern is more accurately constrained to its desired mode. In a solid patch imperfections or variations in the material may lend to distortions. The improved cross-polarisation performance of the gridded patch is perhaps also indicative of this.

Figure 2B:
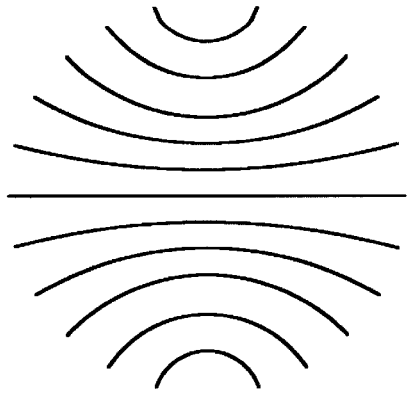
Figure 3B:
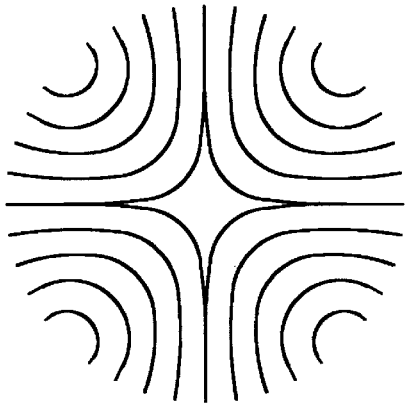

The conductor patterns of FIGS. 2 and 3 are for disc-like patches. Annular gridded patches may be employed in place of solid annular patches simply by leaving the conductor patterns unprinted in a circular central region, but with an interconnection between the conductors around the inner edge of the annulus. Alternatively a combination solid and gridded patch may be produced by printing a solid circular panel of conductive material in the centre of the conductor pattern (or vice versa), provided that the remaining patterned area is sufficient to force the patch to adopt the required excitation mode. A circular patch with a solid centre was found to have better gain, cross polarisation and front to back ratio compared to a patch with an open centre when operated in the $TM_{01}$ mode.

In the embodiments so far described the radiating patch is a grid, and the ground plane is solid. However the ground plane may be gridded instead, or both patch and ground plane may be gridded. Thus, if the antenna is to be attached to or forms part of a window, the ground plane may be formed as a grid or mesh so that it has a useful degree of transparency. We have found that for the circular mode patterns, a ground plane pattern in the form of a square mesh produces good (ie. low) cross-polarisation, A suitable transparent dielectric for use between the ground plane and the radiating element is a material such as polymethylmethacrylate (Perspex®).

Alternatively if the radiating element and ground plane can be adequately supported on thin sheets of transparent insulating material, arranged parallel to but spaced from each other, air may be employed as the dielectric between them.

However the preferred method of providing an antenna according to the invention on a window is to print the radiating element and the ground plane directly on to opposite sides of the glass, or (particularly if the window is of laminated construction), to incorporate one or both of them within it. Conventional techniques for incorporating antennas or heating elements within glass for road vehicle or aircraft applications may be employed for this purpose. A gridded patch whether printed on to glass or other substrate or incorporated within it is expected to be more tolerant of differential thermal expansion between itself and the substrate than is a solid patch.

An antenna employing a gridded patch and a gridded ground plane is likely to have a better bandwidth than a comparable gridded patch with a solid ground plane. It also has a degree of optical transparency. On the other hand an antenna with a solid ground plane is likely to have better cross-polarisation performance than one with a gridded ground plane. Both are likely to have superior cross-polarisation performance (perhaps 8 dB or more) compared to a conventional antenna with a solid patch and a solid ground plane.

The invention may be applied to patch antennas other than of circular or annular shape, where it is required to force the antenna to operate only in a preferred excitation mode. For example, suitable conductor patterns may be employed for elliptical patches, or for square or rectangular patches. FIG. 7 shows a square patch in which the conductor pattern is a series of lines parallel to a diagonal of the patch, the conductors for the adjusting currents extending parallel to the other diagonal. The two sets of conductors intersect orthogonally; if the patch were rectangular rather than square or elliptical rather than circular the intersection may not be orthogonal, but the required excitation mode would still be imposed.

The FIG. 7 patch is configured to produce a circularly polarised signal; two opposite corners of the patch are removed, and this (as known per se) introduces perturbations in to the current pattern such that a circularly polarised signal is transmitted.

Other known techniques for stimulating circularly polarised transmission from a patch antenna may be employed, for example cut-outs or the addition of a perturbation segment, as appropriate to the shape of the patch.

Thus, for circular patches, circular polarisation may be induced by feeding two signals of $\lambda/4$ phase difference to the radiating element pattern at two points $\pi/2$ (90°) apart. Alternatively a cut-out or perturbation segment may be provided so as to provide two modes excited in equal amplitude and 90° out of phase at the centre frequency from a single current input.

Each feature disclosed in this specification (which term includes the claims) and/or shown in the drawings may be incorporated in the invention independently of other disclosed and/or illustrated features.

The text of the abstract filed herewith is repeated here as part of the specification.

A patch antenna comprises a radiating element and a ground plane with a dielectric therebetween, one or both of the radiating element and the ground plane comprising means defining current paths in a pattern which approximates to a preferred excitation mode of a patch radiating element of uniform and continuous section.

What is claimed is:

1. A patch antenna comprising a radiating element (10) and a ground plane (12) with a dielectric (14) therebetween, one or both of the radiating element and the ground plane comprising a plurality of spaced discrete elongated conductors, each substantially longer than its width, the conductors being arranged in a pattern approximating to a pattern of currents which are present in an equivalent patch radiating element of uniform and continuous cross-section when said equivalent element is excited in a selected excitation mode.

2. An antenna as claimed in claim 1, wherein the radiating element is shaped to stimulate circularly-polarized emission from the radiating element.

3. An antenna as claimed in claim 2, wherein the radiating element comprises at least one notch or projection, whereby it is adapted to emit circularly-polarized signals.

4. An antenna as claimed in claim 1, wherein the pattern of currents approximates to an excitation mode in which the pattern of current paths is circular or annular.

5. An antenna as claimed in claim 4, wherein the pattern of currents approximates the current paths in the $TM_{01}$ mode or the $TM_{11}$ mode or the $TM_{21}$ mode.

6. An antenna as claimed in claim 1, wherein the pattern of currents approximates to an excitation mode in which the pattern of current paths is square or rectangular.

7. An antenna as claimed in claim 6, wherein the pattern of currents approximates the current paths in the $TM_{10}$ mode or $TM_{11}$ mode or $TM_{21}$ mode.

8. An antenna as claimed in claim 6, wherein the pattern of conductors occupies a substantially rectangular or square shape, and the elongated conductors and the second conductors of the pattern are substantially parallel to a diagonal thereof.

9. An antenna as claimed in claim 6, being of square shape and wherein opposite corners of the square shape are absent, whereby the radiating element is adapted to emit circularly-polarized signals.

10. An antenna as claimed in claim 1, wherein a solid dielectric is disposed between the radiating element and the ground plane.

11. An antenna as claimed in claim 10, wherein both the radiating clement and the ground plane are comprised of the plurality of spaced discrete elongated conductors, and wherein the dielectric is transparent.

12. An antenna as claimed in claim 1, wherein the ground plane comprises the plurality of spaced discrete elongated conductors, and is printed on or otherwise carried by a glass or other transparent substrate.

13. A patch antenna as claimed in claim 1, comprising at least two radiating elements, one or more of which comprises said plurality of spaced discrete elongate conductors defining current paths, the radiating elements being stacked side-by-side or being stacked concentrically.

14. A window glass or other optically-transparent substrate or a vehicle body part, comprising an antenna as claimed in claim 1.

15. A patch antenna comprising a radiating element (10) and a ground plane (12) with a dielectric (14) therebetween, one or both of the radiating element and the ground plane comprising a plurality of spaced discrete elongated conductors, each substantially longer than its width, the conductors being arranged in a pattern approximating to a pattern of currents which are present in an equivalent patch radiating element of uniform and continuous cross-section when said equivalent element is excited in a selected excitation mode, one or both of the radiating element and ground plane also comprising connections for permitting minor currents to flow between respective adjacent pairs of the elongated conductors.

16. An antenna as claimed in claim 15, wherein the connections for permitting minor currents to flow comprises a plurality of spaced discrete second conductors that intersect the elongated conductors to form a grid pattern.

17. An antenna as claimed in claim 16, wherein the elongated conductors intersect with the second conductors substantially orthogonally.

18. A method of transmitting or receiving radio-frequency energy, wherein the transmission or reception is by means of an antenna comprising a radiating element (10) and a ground plane (12) with a dielectric (14) therebetween, one or both of the radiating element and the ground plane comprising a plurality of spaced discrete elongated conductors, each substantially longer than its width, the conductors being arranged in a pattern approximating to a pattern of currents which are present in an equivalent patch radiating element of uniform and continuous cross-section when said equivalent element is excited in a selected excitation mode.

19. A method as claimed in claim 18, wherein one or both of the radiating element and the ground plane also comprises connections for permitting minor currents to flow between respective adjacent pairs of the elongated conductors.

20. A method as claimed in claim 19, wherein the connections for permitting minor currents to flow comprises a plurality of spaced discrete second conductors that intersect the elongated conductors to form a grid pattern.

* * * * *